United States Patent [19]

Chupp, Jr.

[11] 4,182,509

[45] Jan. 8, 1980

[54] EXERCISE DEVICE

[76] Inventor: Thomas M. Chupp, Jr., 2479 Jewell Dr., Marietta, Ga. 30066

[21] Appl. No.: 789,588

[22] Filed: Apr. 21, 1977

[51] Int. Cl.[2] ..... A63B 23/02

[52] U.S. Cl. ..... 272/93; 272/900

[58] Field of Search ..... 272/900, 144, 145, 93, 272/134, 143, 109

[56] References Cited

U.S. PATENT DOCUMENTS

| | | | |
|---|---|---|---|
| 1,953,857 | 4/1934 | Hunter | 272/145 |
| 2,050,652 | 8/1936 | Fleming | 272/900 X |
| 2,425,971 | 8/1947 | Walker | 272/144 |
| 2,938,695 | 5/1960 | Ciampa | 272/900 |
| 3,134,592 | 5/1964 | Sharkey | 272/900 X |
| 3,287,016 | 11/1966 | Mayer | 272/144 X |
| 3,567,218 | 3/1971 | Johnson | 272/144 |

*Primary Examiner*—Richard J. Johnson

*Attorney, Agent, or Firm*—Sughrue, Rothwell, Mion, Zinn and Macpeak

[57] ABSTRACT

An exercise device for use in performing "sit-up" exercises comprises a base member for placement under a door, side members for embracing either side of the door, and a foot rest extending from one of the side members. The user's feet can be hooked under the foot rest to hold them in place during sit-ups.

5 Claims, 4 Drawing Figures

EXERCISE DEVICE

BACKGROUND OF THE INVENTION

This invention relates to exercise devices, and more particularly, to a device for securing the feet of a person engaged in "sit-up" exercises. Sit-ups, i.e., exercises in which a person reclining on a horizontal surface secures his feet to that surface and uses his abdominal muscles to raise his upper body to a sitting position, are well recognized as a means of obtaining physical fitness, and especially as a means for maintaining a trim wastline. In order to perform sit-ups it is necessary that the person secure his feet to the surface on which he is reclining.

In a gym or other exercise room, securing the feet is typically achieved by hooking them under a stirrup which is fastened to the surface upon which the person is reclining, either the floor itself or an exercise table. However, such a stirrup is not available to the great number of people who perform sit-ups in their homes, since a stirrup fastened to the floor would be unattractive and a large exercise table would take up too much space. Therefore, it is a common practice to hook one's feet under a piece of furniture such as a sofa or a heavy chair in order to secure the feet to the floor during sit-ups. This solution has been unsatisfactory because the exerciser often must turn his feet sideways at uncomfortable angles in order to fit them underneath the furniture and, since the underside of the furniture is a planar surface, much of the securing force must be borne by the toes. As a result, sit-ups must be performed in great discomfort.

There is a need, then, for a device for securing the feet of a person engaged in sit-up exercises which can be easily stored when not in use.

One such device is described in U.S. Pat. No. 2,425,971. Shown in FIG. 4 of that patent is a device having a transverse bar for securing the feet during sit-ups. The bar is mounted on a frame having a U-shaped section which can be slid underneath a door to hold it in place. The user sits on a rocking seat at a level slightly above the transverse bar, hooks his feet under the bar and performs sit-ups aided by the rocking motion of the seat. Such a device, while more effective for securing the feet than heavy furniture, does present some problems. First, the transverse bar is fixed at a predetermined height and, therefore, cannot accommodate a variety of people of different sizes. It is apparent to one experienced in the art of sit-ups that if the foot securing bar does not fit snugly against the lower leg of the user, the sudden upward surge of the torso at the beginning of each sit-up will cause the user's legs to suddenly and quite painfully strike the bar. Second, the U-shaped section of the frame is of fixed dimensions and, therefore, can only be used on a door of precisely the correct thickness. If the U-shaped section fits at all loosely it will rock back and forth, causing annoyance to the user and damaging the door. In order to prevent this problem of "rocking", the U-shaped section must fit quite snugly around the bottom of the door, with the result that it would be difficult to install and remove without scraping or otherwise damaging the surface of the door.

SUMMARY OF THE INVENTION

Accordingly, it is an object of this invention to provide a device for securing the feet of a person engaged in the performance of sit-ups which is simple in construction, lightweight, comfortable, easily stored when not in use, and can be used equally well by people of different sizes.

It is a further object of this invention to provide such a device which is easily installed on and removed from the bottom of a door and can be used equally well on a wide variety of doors without doing damage to any of them.

DETAILED DESCRIPTION OF THE PREFERRED EMBODIMENT

Figure 1:
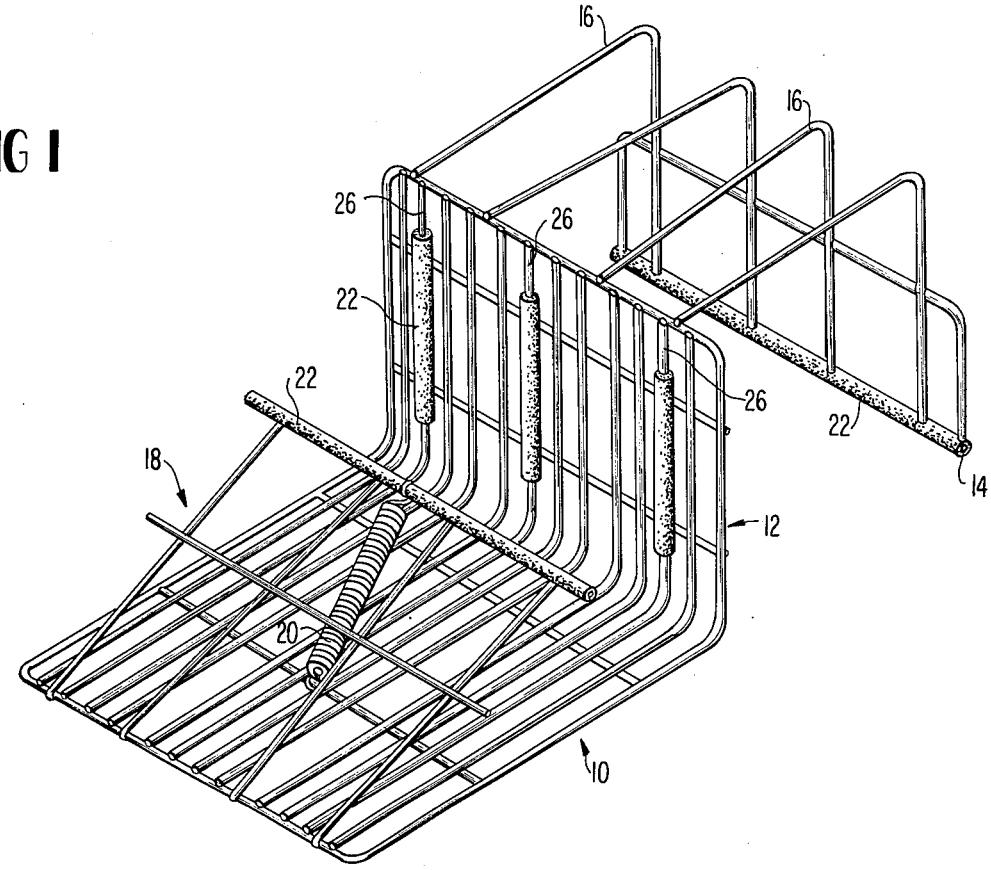
FIG. 1 is a perspective view of an exercise device according to one embodiment of the present invention.
Figure 2:
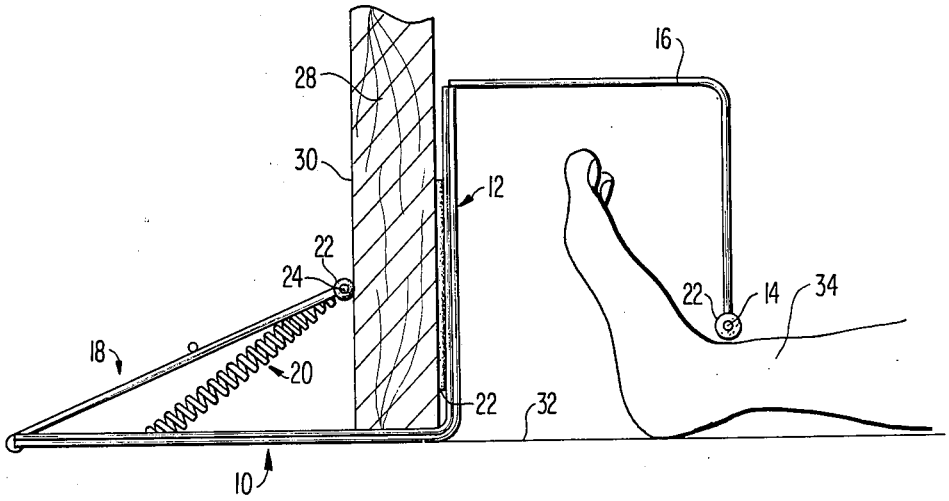
FIG. 2 is a side view of the device of FIG. 1 installed and ready for use.

As shown in FIGS. 1 and 2, the exercise device according to the present invention includes a frame having a bottom portion 10, a vertically extending side frame portion 12, a foot-securing bar 14 mounted on bar-supporting members 16 and a swinging frame portion 18 connected to the bottom frame 10 by a spring 20. Suitable padding 22, e.g. foam rubber, surrounds the foot-securing bar 14, the upper transverse bar 24 of the swinging frame 18, and several vertically extending bars 26 of the side frame 12.

In operation, the swinging frame 18 is pulled toward a vertical position against the biasing tension of the spring 20 in order to provide sufficient clearance between the upper transverse bar 24 of the swinging frame 18 on the one hand and the side frame 12 on the other hand. The bottom frame 10 is then slid beneath the door and the swinging frame 18 is released. The biased spring 20 pulls the upper transverse bar 24 downwardly, thereby swinging the frame 18 against the left side 30 of the door 28 so that a clamping action is achieved. In this manner, the exercise device can be held snugly against a door of any size and the door is contacted on either side only by the padding sections 22 surrounding the upper transverse bar 24 and the vertically extending bar 26, respectively.

The bar-supporting members 16 maintain the bar 14 a sufficient distance from the floor 32 to accommodate the feet of a relatively small person. The bar-supporting members 16 are of a properly chosen size and strength so that they may successfully sustain the force exerted on them during a sit-up while being slightly resilient so that the foot-securing bar 14 may be raised sufficiently to accommodate the feet of a larger person. Thus, the foot-securing bar fits snugly against the lower leg 34 of the user and is surrounded by a padding section 22 to eliminate discomfort.

Figure 3:
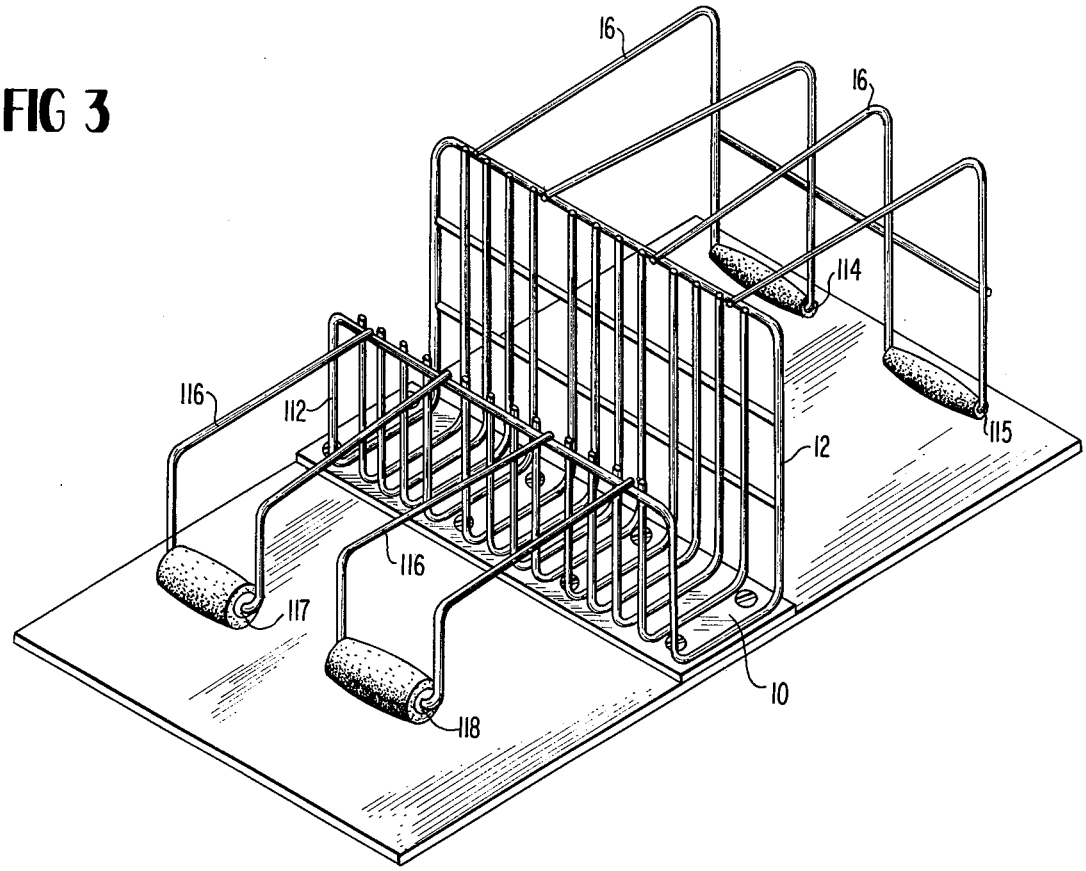
FIG. 3 is a perspective view of an alternative embodiment of an exercise device according to the present invention.
Figure 4:
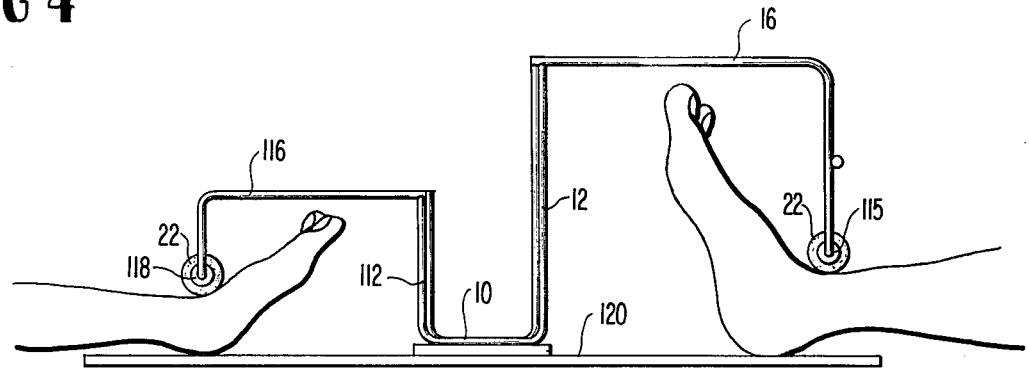
FIG. 4 is a side view of the exercise device shown in FIG. 3.

Referring now to FIGS. 3 and 4, an alternative embodiment of the exercise device according to the present device is illustrated which may be used by either one or two persons. This embodiment also contains a bottom frame 10, a vertically extending side frame 12 and bar-supporting members 16. The device, as illustrated, includes separate foot-securing bars 114 and 115 although it will be apparent to one skilled in the art that the device of FIG. 3 could perform equally as well with a single bar such as that designated by reference numeral 14 in FIG. 1. This alternate embodiment also includes a second vertically extending side frame 112, a second set of bar-supporting members 116 and their associated foot-securing bars 117 and 118. This device is mounted on a base 120 and can be used by either one or two exercise subjects. When used by two subjects, they may control their timing so that the forces exerted by their respective feet will balance each other and the exercise device will be stabilized. When used by one person the device may be slid under a door and the base 120 will provide sufficient stability so that the device will have a sturdy, non-rocking action, and there is no need for a clamping member on the opposite side of the door. Even where no door is available, the base 120 will provide sufficient stability to allow one person to use the device. As in the device of FIG. 1, all foot-securing bars are covered with a suitable padding 22 to eliminate discomfort.

The afore-described exercise device is simple in construction, comfortable, easily stored when not in use and can be used on a wide variety of doors without the occurrence of any "rocking" action which may both annoy the user and damage the door.

It will be apparent to those skilled in the art that many changes and modifications may be made to the embodiments shown and described herein without departing from my invention in its broadest aspects. It, therefore, is to be understood that the appended claims are intended to cover these embodiments and all other such modifications and changes as fall within the true spirit and scope of my invention.

What is claimed is:

1. An exercise device comprising a flat base adapted to rest on the floor, a substantially U-shaped frame secured to said base defining first and second vertically disposed supports and first and second foot securing means secured to each of said supports, respectively; said foot securing means extending laterally outwardly from said supports in opposite directions in spaced relation above said flat base, and said flat base extending beyond said foot securing means in each direction, each of said foot securing means including at least one horizontal bar parallel to said base and each other so that two people facing each other may secure their feet under a respective bar for simultaneous use of the exercise device.

2. An exercise device as set forth in claim 1 wherein one of said supports is higher than the other of said supports.

3. An exercise device as set forth in claim 1 wherein each of said securing means is comprised of a single horizontally disposed bar.

4. An exercise device as set forth in claim 1 wherein each of said securing means is comprised of a pair of horizontal bars.

5. An exercise device as set forth in claim 1 wherein said first and second securing means are covered with padded material.

* * * * *